US011377920B2

(12) United States Patent
Parameshwaraiah et al.

(10) Patent No.: US 11,377,920 B2
(45) Date of Patent: Jul. 5, 2022

(54) ANCHORING DOWNHOLE TOOL HOUSING AND BODY TO INNER DIAMETER OF TUBING STRING

(71) Applicant: Halliburton Energy Services, Inc., Houston, TX (US)

(72) Inventors: Rajesh Parameshwaraiah, Houston, TX (US); Lonnie Carl Helms, Houston, TX (US); Frank Vinicia Acosta Villarreal, Houston, TX (US); Maithri Muddasani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 17/011,526

(22) Filed: Sep. 3, 2020

(65) Prior Publication Data

US 2022/0065059 A1 Mar. 3, 2022

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 3,077,933 A * 2/1963 Bigelow ..... E21B 23/01 166/217
3,606,923 A * 9/1971 Berryman ..... E21B 23/06 166/125
3,912,006 A * 10/1975 Nutter ..... E21B 33/1246 166/216
4,336,841 A * 6/1982 Garner, Jr. ..... E21B 23/01 166/139
4,489,781 A * 12/1984 Weeks ..... E21B 43/10 166/208
4,583,590 A * 4/1986 Greenlee ..... E21B 33/129 166/140
4,600,058 A * 7/1986 Van Wormer ..... E21B 17/02 166/123
4,750,559 A * 6/1988 Greenlee ..... E21B 23/01 166/216
5,048,612 A * 9/1991 Cochran ..... E21B 43/10 166/382

(Continued)

*Primary Examiner* — Steven A Macdonald
(74) *Attorney, Agent, or Firm* — Sheri Higgins Law, PLLC; Sheri Higgins

(57) ABSTRACT

A method of anchoring a housing to an inner diameter of a tubing string can include: installing an anchoring assembly at an end of the tubing string, the anchoring assembly comprising: a body; the housing; an installation sleeve; a rotating sleeve in threaded connection with the housing and the installation sleeve; and a plurality of anchoring buttons located within a plurality of cutouts on the housing; causing movement of the body along a longitudinal axis of the tubing string towards the end of the tubing string that causes the plurality of anchoring buttons to circumvolve around a pin and an edge of the anchoring buttons lockingly engages with the ID of the tubing string after circumvolving; releasing both of the installation sleeve and the rotating sleeve from engagement with the tubing string, the body, and the housing; and removing the installation sleeve and the rotating sleeve from the anchoring assembly.

19 Claims, 6 Drawing Sheets

(56) References Cited

U.S. PATENT DOCUMENTS

| | | | | |
|---|---|---|---|---|
| 5,984,007 | A | 11/1999 | Yuan et al. | |
| 6,491,116 | B2 | 12/2002 | Berscheidt et al. | |
| 6,793,022 | B2 | 9/2004 | Vick et al. | |
| 8,047,279 | B2 * | 11/2011 | Barlow | E21B 33/129 166/134 |
| 8,496,052 | B2 | 7/2013 | Frazier | |
| 8,596,347 | B2 | 12/2013 | Valencia et al. | |
| 9,175,533 | B2 | 11/2015 | Standridge | |
| 9,835,003 | B2 | 12/2017 | Harris et al. | |
| 10,000,991 | B2 | 6/2018 | Harris et al. | |
| 10,415,335 | B2 | 9/2019 | Mhaskar et al. | |
| 10,774,602 | B2 * | 9/2020 | Mlcak | E21B 23/01 |
| 2008/0230233 | A1 * | 9/2008 | Fay | E21B 23/02 166/382 |

* cited by examiner

ANCHORING DOWNHOLE TOOL HOUSING AND BODY TO INNER DIAMETER OF TUBING STRING

TECHNICAL FIELD

The field relates to an anchoring device for anchoring a body and housing of a downhole tool to an inside of a tubing string. The tubing string can be a casing string.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
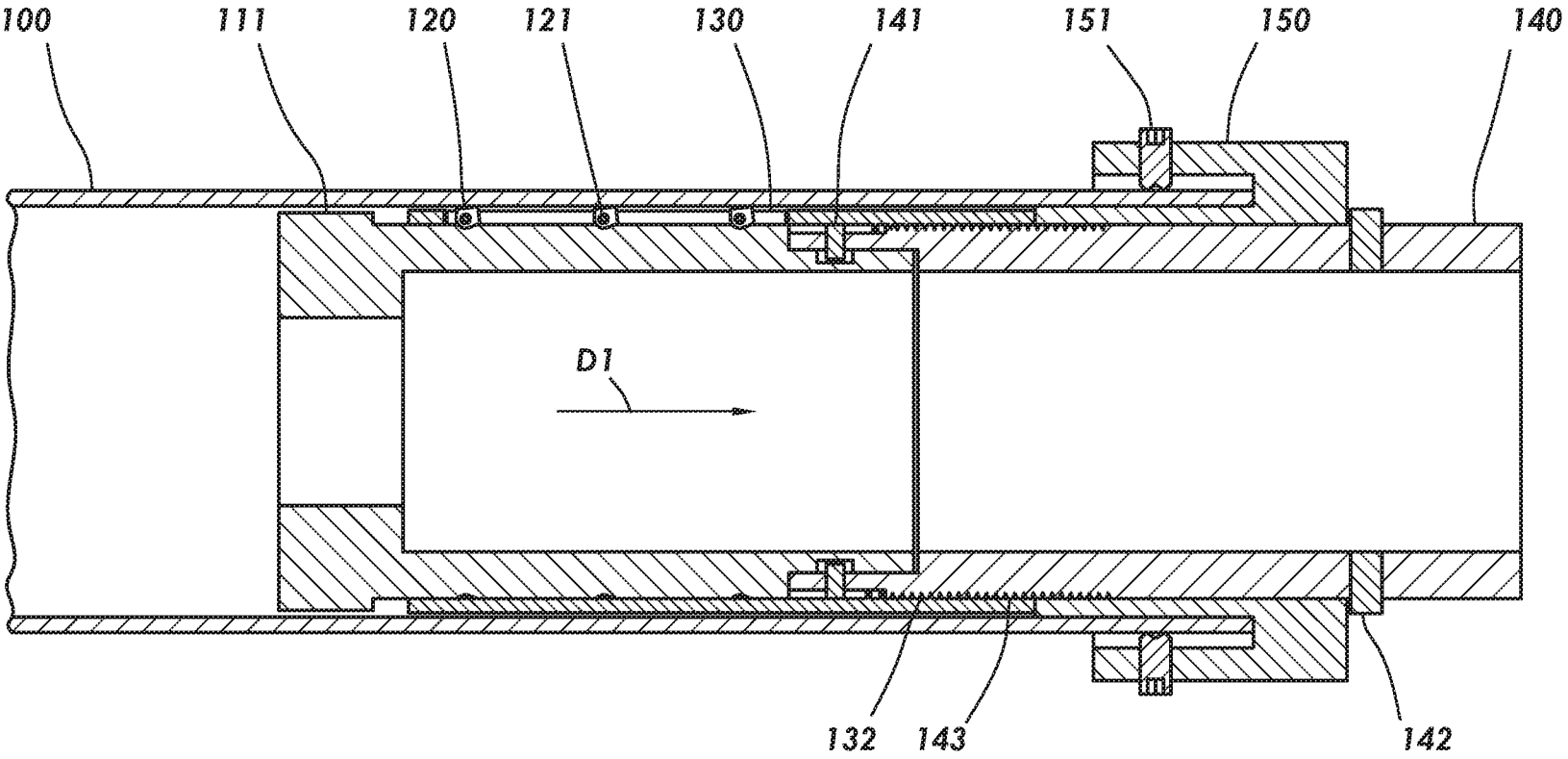
FIG. 1 is cross-sectional view of an assembly for anchoring a body and housing of a downhole tool component to an inside of a tubing string prior to anchoring a housing to a tubing string.

Oil and gas hydrocarbons are naturally occurring in some subterranean formations. In the oil and gas industry, a subterranean formation containing oil and/or gas is referred to as a reservoir. A reservoir can be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wall of the wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

There are a variety of wellbore operations that can be performed on a well. A wellbore is formed using a tool called a drill bit. A tubing string, called a drill string for drilling operations, can be used to aid the drill bit in drilling through a subterranean formation to form the wellbore. The drill string can include a drilling pipe. During drilling operations, a drilling fluid, sometimes referred to as a drilling mud, is circulated downwardly through the drilling pipe, and back up the annulus between the wall of the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

During well completion and after the wellbore is formed, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

In order to perform a cementing operation during well completion, a casing is generally run into the wellbore. The casing can include downhole tool components at various locations in the casing string. Downhole tool components that are typically located near the bottom of the casing string (i.e., farthest away from the wellhead) include valves, landing seats, plugs, and shut-off collars. Some components are run-in with the casing string, while other components can be installed after the casing string has been run into the wellbore.

Components such as a casing collar or shoes are generally secured to the casing string and contain threads for securing a housing of a downhole tool to the casing or casing collar. Depending on the specifics of a particular wellbore, the threads must be specially manufactured. Having such threads specially manufactured can increase costs in addition to time waiting for the threads to be made.

Therefore, there is a need for improved ways to anchor a housing and body for downhole tool components to the inside of a tubing string, while overcoming the challenges currently faced in the industry.

It has been discovered that an anchoring assembly can be used to anchor a housing of a downhole tool component to the inside of a tubing string. One of the advantages to the anchoring assembly is the assembly can be used to secure a variety of downhole tool components to a multitude of different tubing strings without requiring traditional threads. By eliminating threads as a necessary component, money and time are saved.

A system for anchoring a housing to an inner diameter of a tubing string can include: a wellbore tool component; and an anchoring assembly positioned at an end of the tubing string, the anchoring assembly comprising; a body; the housing, wherein the housing is positioned around an outer circumference of at least a portion of the body; an installation sleeve; a rotating sleeve in threaded connection with the housing and the installation sleeve; and a plurality of anchoring buttons located within a plurality of cutouts on the housing, wherein the plurality of anchoring buttons circumvolve around a pin, and wherein an edge on the plurality of anchoring buttons lockingly engages with the inner diameter of the tubing string.

Methods of anchoring a housing to an inner diameter of the tubing string can include: installing the anchoring assembly to an end of the tubing string; causing movement of the body along a longitudinal axis of the tubing string toward the end of the tubing string, wherein the movement causes the plurality of anchoring buttons to circumvolve around a pin, and wherein an edge on the plurality of anchoring buttons lockingly engages with the inner diameter of the tubing string after circumvolving; releasing both of the installation sleeve and the rotating sleeve from engagement with the tubing string, the body, and the housing; and removing the installation sleeve and the rotating sleeve from the anchoring assembly.

Any discussion of the embodiments regarding the anchoring assembly or any component related to the anchoring assembly is intended to apply to all of the apparatus, system, and method embodiments.

Turning to the Figures, FIG. 1 is a cross-sectional view of an anchoring assembly. The anchoring assembly is located at or near a bottom of a tubing string 100. The tubing string 100 can be a casing string or a tubing string that can be positioned inside a casing string. The anchoring assembly includes a body 111, a housing 130, a rotating sleeve 140, and an installation sleeve 150.

The body 111 is releasably attached to the rotating sleeve 140 by a first frangible device 141. The first frangible device 141 can be any device that is capable of withstanding a predetermined amount of force and capable of releasing at a force above the predetermined amount of force. The first frangible device 141 can be, for example, a shear pin, a shear screw, a shear ring, a load ring, a lock ring, a pin, or a lug. There can also be more than one first frangible device 141 that connects the body 111 to the rotating sleeve 140. The first frangible device 141 or multiple frangible devices can be selected based on the force rating of the device, the total number of devices used, and the predetermined amount of force needed to release the device. For example, if the total force required to break or shear the frangible devices is 15,000 pounds force ($lb_f$) and each frangible device has a rating of 5,000 $lb_f$, then a total of three frangible devices may be used.

The rotating sleeve 140 is in threaded connection to the housing 130 and the installation sleeve 150. As shown in FIG. 1, a portion of the rotating sleeve 140 can include threads 143 and a portion of the housing 130 can include threads 132. The threads on the rotating sleeve 140 and the housing 130 can be designed such that rotation (e.g., clockwise or counter-clockwise) of the rotating sleeve 140 causes the body 111 and rotating sleeve 140 to move in the direction D1 along a longitudinal axis of the tubing string.

The installation sleeve 150 is located at an end of the tubing string 100. The installation sleeve 150 can wrap around the end of the tubing string 100 such that a portion of the installation sleeve 150 is adjacent to the inner diameter (ID) 101 and a portion of the installation sleeve is adjacent to the outer diameter (OD) 102 of the tubing string 100. The installation sleeve 150 is removably attached to the tubing string 100 via a fastener 151. The fastener 151 can be, for example, a screw or set screw. The fastener 151 can penetrate through the portion of the installation sleeve 150 adjacent to the OD 102 of the tubing string 100 and into the outside of the tubing string 100. In this manner, the installation sleeve 150 is secured to the tubing string 100. A second frangible device 142, which can be the same type or different from the first frangible device 141, can be located at the bottom of the installation sleeve 150 and penetrate into the rotating sleeve 140 to provide a stop for the installation sleeve from moving in direction D1.

Figure 3:
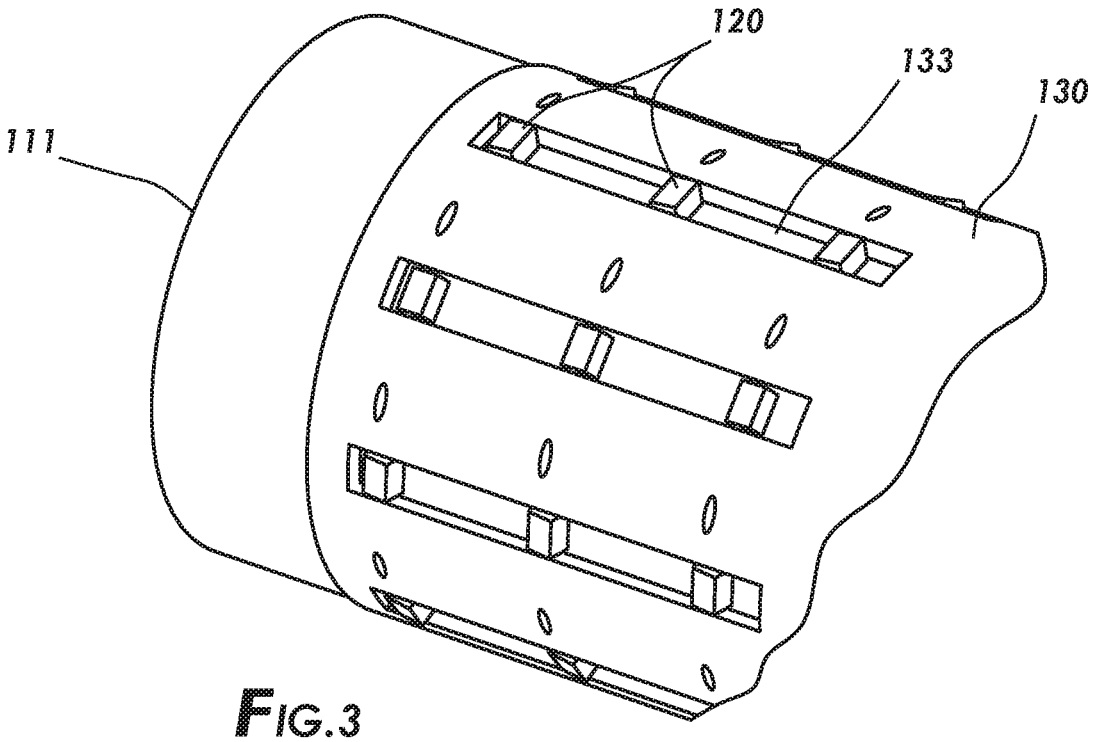
FIG. 3 is partial perspective view of a body and a housing of the assembly showing multiple rows of the anchoring buttons.

The anchoring assembly includes a plurality of anchoring buttons 120. The anchoring buttons 120 can be arranged around the outer circumference of the body 111. As shown in FIG. 3, the housing 130 includes a plurality of cutouts 133. The cutouts 133 can penetrate the entire thickness of the housing 130 such that the body 111 is exposed within each cutout 133. According to any of the embodiments, there can be at least two cutouts 133 that are preferably spaced equidistant around the housing 130. In this manner, uniform anchoring of the housing can be achieved. There can also be more than two cutouts 133. The number of cutouts 133 can range from 2 to 12. The number of cutouts can be selected to provide anchoring of the housing 130 to the ID 101 of the tubing string 100. Preferably, the spacing of the cutouts 133 is equidistant regardless of the number of cutouts. The cutouts 133 can have dimensions ranging from 0.50 inch to 2.5 inches in width and 4 to 6 inches in length. The cutouts 133 can also have dimensions selected that accommodate the dimensions of the anchoring buttons 120, the total number of buttons that are to be included within each cutout, and the desired spacing between each of the buttons within each cutout.

The anchoring buttons 120 fit within the cutouts 133. Although shown in the drawings with three anchoring buttons 120 located in one cutout 133, it is to be understood that less than three or more than three anchoring buttons 120 can be located in each of the cutouts 133. The number of the anchoring buttons 120 located in each of the cutouts 133 can be selected based on the total number of cutouts 133, the outer diameter (OD) of the body 111, and predicted force that may be applied to the anchored housing. The total number of anchoring buttons 120 can be selected based on the shear strength of each button and the total force that may be applied to the anchored housing. Preferably, the total number of anchoring buttons 120 is selected such that the housing 130 remains anchored to the ID 101 of the tubing string 100 during the applied force. The anchoring buttons 120 can be spaced within the cutouts 133 such that there is sufficient clearance between the outer perimeter of the anchoring buttons 120 and the walls of the cutouts 133 to allow room for the anchoring buttons 120 to circumvolve around a pin.

Figure 2A:
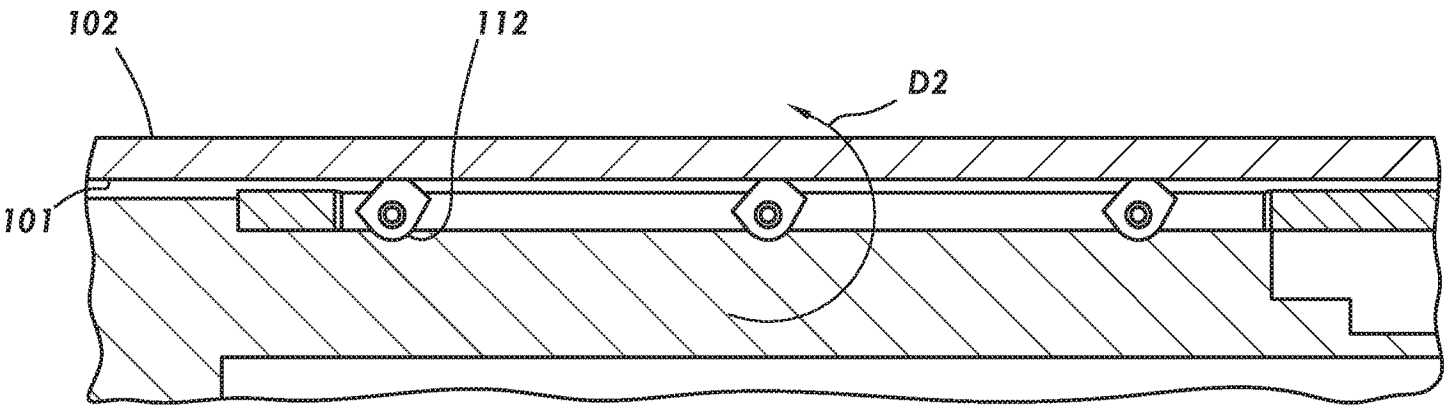
FIG. 2A is an enlarged cross-sectional view of the assembly showing anchoring buttons engaged with the inside of the tubing string.
Figure 2B:
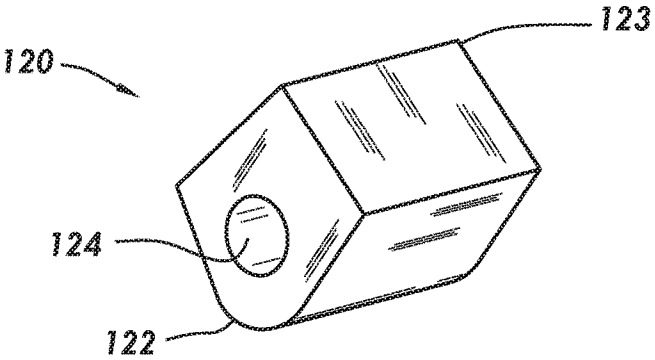
FIG. 2B is a front perspective view of an anchoring button.

FIG. 2B shows a perspective view of an anchoring button 120. The anchoring buttons 120 include a rounded portion 122 and two faces that define an edge 123. The edge 123 is responsible for anchoring the housing 130 to the ID 101 of the tubing string 100. As will be discussed in more detail below, the edge 123 cuts into the ID of the tubing string 100 and wedges the anchoring buttons 120 into the tubing string 100. The edge 123 is shown having an angle of approximately 90°; however the edge 123 can have an angle in the range of 80°-110°.

The anchoring buttons 120 can have a length in the range of 0.5 to 2 inch, a width in the range of 0.75 to 2 inch, and a height in the range of 0.5 to 2.5 inch.

Figure 4:
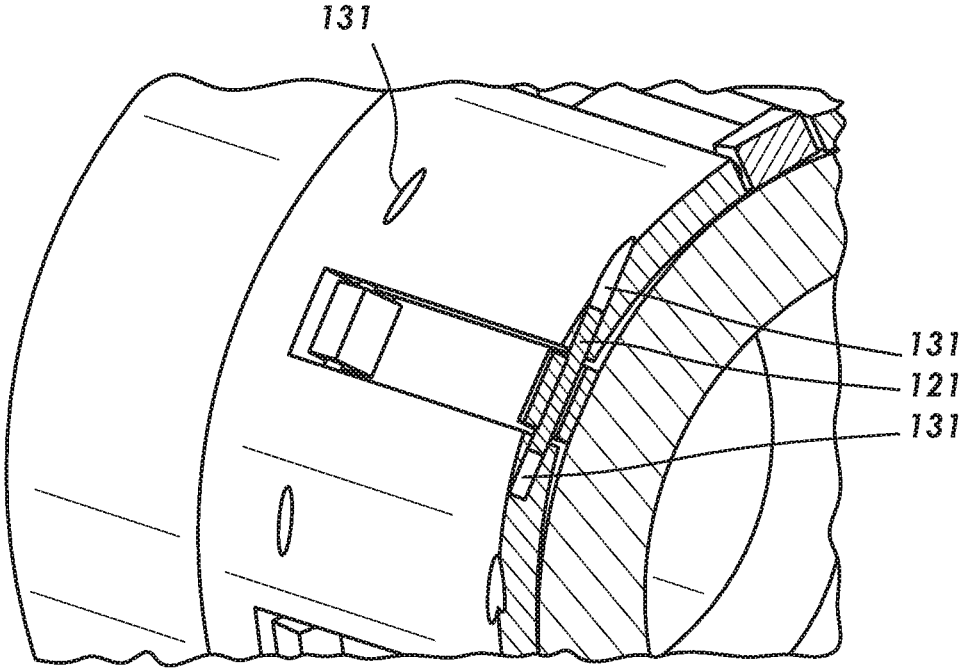
FIG. 4 is a circumferential cross-sectional view of the body and housing of FIG. 3 showing a pin inserted into the housing for holding the anchoring buttons.

The anchoring buttons 120 also include a hole 124 that runs through an area in the middle or near the middle of the button. As can be seen in FIG. 4, each of the anchoring buttons 120 are secured within the cutouts 133 of the housing by a pin 121. The pin 121 has an OD that is smaller than the hole 124 of the anchoring buttons 120. In any of the embodiments, the pin 121 has an OD that is in the range of −2% to −10% smaller than the ID of the hole 124. In this manner, the anchoring buttons 120 can freely circumvolve around the pins 121. Preferably, the OD of the pins 121 is selected such that the anchoring buttons 120 can circumvolve around the pin while still being firmly secured within the cutouts 133. By way of example, the ID of the hole 124 can be in a range of 0.2 to 0.25 inch, and the OD of the pin 121 can be in the range of 0.18 to 0.2 inch. According to any of the embodiments, the OD of the pin 121 is selected such that the pin 121 has a sufficient diameter strength to prevent deformation of the pin 121.

The OD of the pin 121 may also be selected based on the material used for the pin 121. For example, a softer material on a hardness scale may need a larger OD in order to prevent deformation of the pin 121; whereas a harder material could have a smaller OD while still preventing deformation. The pin 121 can be made from a material having a Mohs scale of hardness value of at least 3.5. Examples of materials for the pin 121 can include, but are not limited to, steel, iron, titanium, hardened steel, tungsten, tungsten carbide, and a thermoset plastic. The material of the pin 121 can also be selected such that chemical degradation is prevent or substantially inhibited, such as corrosion, when used in a wellbore operation. Alternatively, the run-in fluid can include a corrosion inhibitor or other additives to prevent degradation of the pin 121.

Still referring to FIG. 4, the housing 130 can include pin end receivers 131. A first end of the pin 121 can be contained within a first pin end receiver 131, and a second end of the pin 121 can be contained within a second pin end receiver 131. The length that each end of the pin 121 penetrates into the housing 130 via the pin end receivers 131 can vary and can be selected such that the pin 121 does not undergo deformation. By way of example, the length of the pin end receivers 131 can be in a range of 2 to 2.5 inch.

Figure 6:
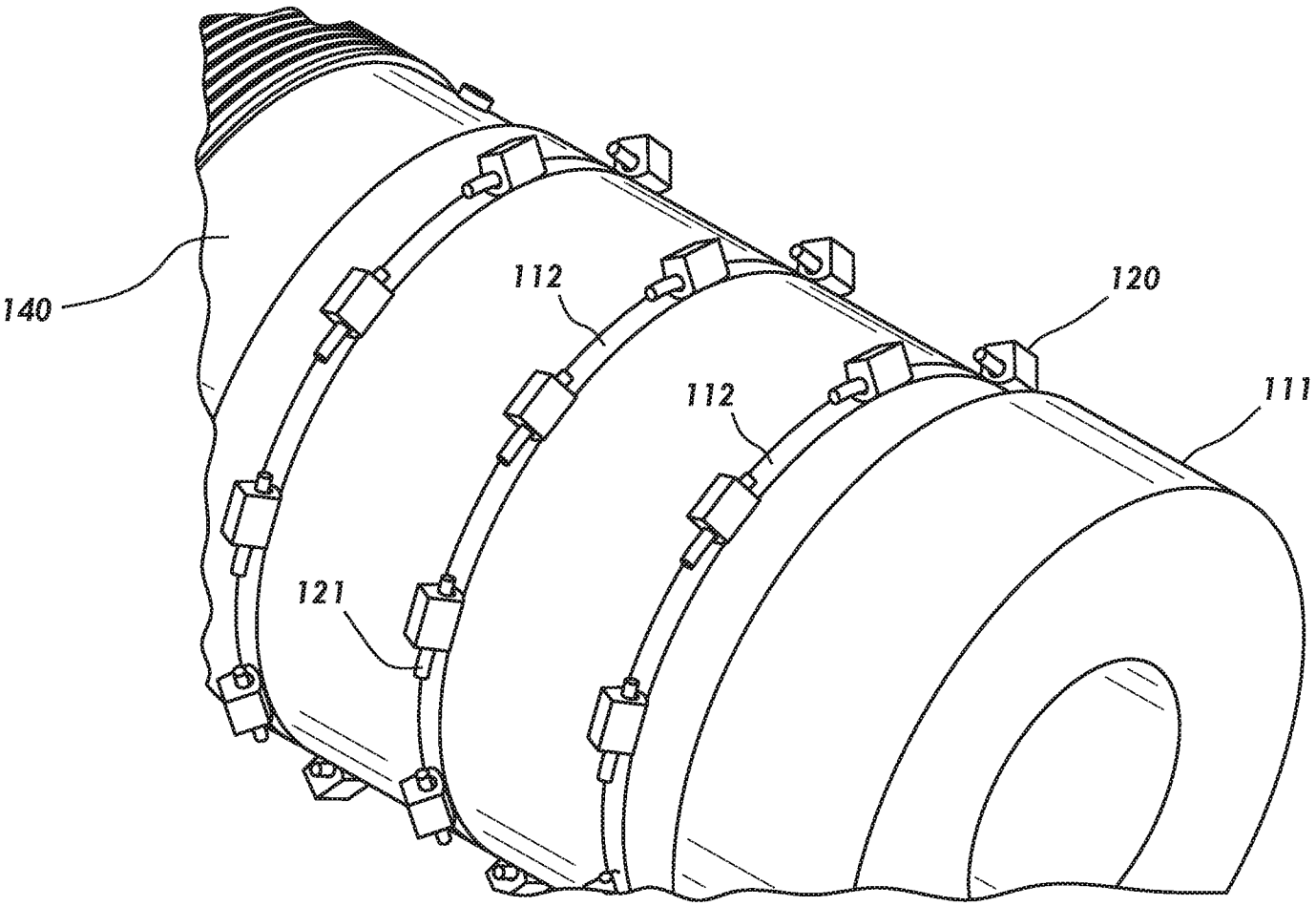
FIG. 6 is partial perspective view of the body without the housing showing grooves in the body for rotational movement of the anchoring buttons.

Turning now to FIG. 6, the body 111 includes one or more grooves 112. Individual, non-connected grooves 112 can be located where each anchoring button 120 is to be positioned. Alternatively, the grooves 112 can span the entire circumference of the body 111 (as shown in FIG. 6). For individual, non-connected grooves, the number and location of each groove can be selected based on the number and location of the anchoring buttons 120. For circumferential grooves, the number and location of each circumferential grove can be selected based on the number of anchoring buttons 120 located in the cutouts 133. By way of example, and as shown in FIG. 6, three anchoring buttons 120 can be located within a single cutout 133. Accordingly, the body 111 can include three circumferential grooves 112, wherein each of the three grooves corresponds to the location of one of the three anchoring buttons 120.

The rounded portion 122 of the anchoring buttons 120 can be positioned within the grooves 112. The grooves 112 have a width and a depth. The width and depth of the grooves 112 can be selected such that the rounded portion 122 of the anchoring buttons 120 can fit within the grooves 112 and provide rotational movement of the anchoring buttons 120 to circumvolve around the pins 121. By way of example, the width of the grooves 112 can be in the range of 0.25 to 0.375 inch, and the depth of the grooves 112 can be in the range of 0.125 to 0.18 inch.

With reference to FIGS. 1 and 2A, the edge 123 on the plurality of anchoring buttons lockingly engages with the inner diameter 101 of the tubing string 100. While the housing 130 remains stationary, movement in the direction D1 of the body 111 creates friction and rotational movement of the anchoring buttons 120 in the direction D2. As the anchoring buttons 120 rotate in direction D2 and circumvolve around the pins 121, the edge 123 lockingly engages with the ID 101 of the tubing string 100.

The material of the anchoring buttons 120 can be selected such that the edge 123 is capable of cutting into the ID 101 of the tubing string 100. In order to cut into the ID, the material of the anchoring buttons 120 should have a Mohs scale of hardness greater than the Mohs scale of hardness of the tubing string 100. For example, a casing string can be made of steel, which has a hardness value of 4-4.5. Accordingly, the anchoring buttons 120 could be made of a material with a hardness value greater than or equal to 5. The greater the increase of the hardness value of the anchoring buttons 120 over the tubing string 100, the easier it will be for the edge 123 of the buttons to cut into the ID. The material of the anchoring buttons 120 can have a hardness value at least 1 more than the hardness value of the tubing string 100. In this manner, the edge 123 of the anchoring buttons 120 can cut into and penetrate a desired depth into the ID of the tubing string 100 and anchor the housing 130 to the tubing string 100. Examples of materials for the anchoring buttons 120 include, but are not limited to, ceramics, hardened steel, titanium, tungsten, diamond, and carbides of any of the foregoing metals (e.g., tungsten carbide). The material of the anchoring buttons 120 can also be selected based on whether the downhole tool component is a permanent device or retrievable device. Retrievable devices can be drilled out of the wellbore. Accordingly, the material to be used for permanent devices may have a higher hardness value, for example, a carbide material. The material to be used for a retrievable device can have a lower hardness value or be more brittle, for example, ceramics in order to aid in retrieval of the downhole tool component.

Figure 5:
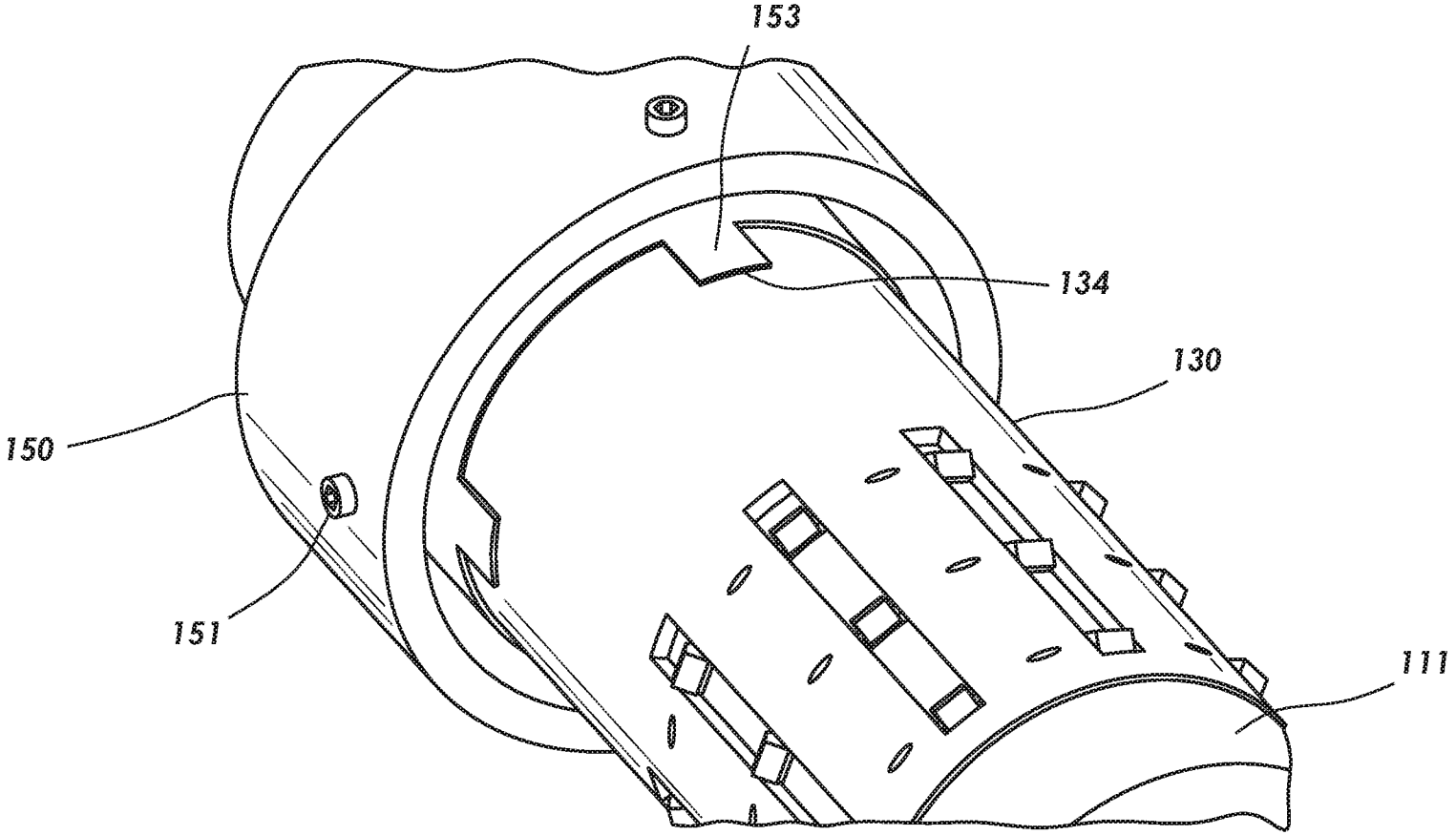
FIG. 5 is perspective view of an installation sleeve connected to the housing.

A method of anchoring the housing 130 to an ID 101 of the tubing string 100 can include causing movement of the body 111 along a longitudinal axis of the tubing string 100 (in the direction D1 for example), wherein the movement causes the plurality of anchoring buttons to circumvolve around a pin. The movement can be caused by rotating the rotating sleeve 140 clockwise or counter-clockwise relative to a longitudinal axis of the tubing string 100. As can be seen in FIGS. 1 and 5, the installation sleeve 150 is secured in place from rotating by the fastener 151 to the bottom of the tubing string 100. As shown in FIG. 5, the installation sleeve 150 and the housing 130 can be inter-connected by castellated protrusions 153 on the installation sleeve 150 and castellated indentations 134 on the housing 130. This castellated inter-connection prevents the housing 130 from rotating. As the rotating sleeve 140 is rotated clockwise or counter-clockwise, the rotating sleeve 140 pulls the body 111 with it in the direction of D1. The movement of the body in the direction D1 causes the plurality of anchoring buttons 120 to circumvolve around a pin 121 in the direction of D2. The rotation of the anchoring buttons 120 causes the edge 123 of the anchoring buttons 120 to cut into the ID 101 of the tubing string 100 and become wedged into the ID 101 to lockingly engage with the ID as shown in FIG. 2A for example.

Figure 7:
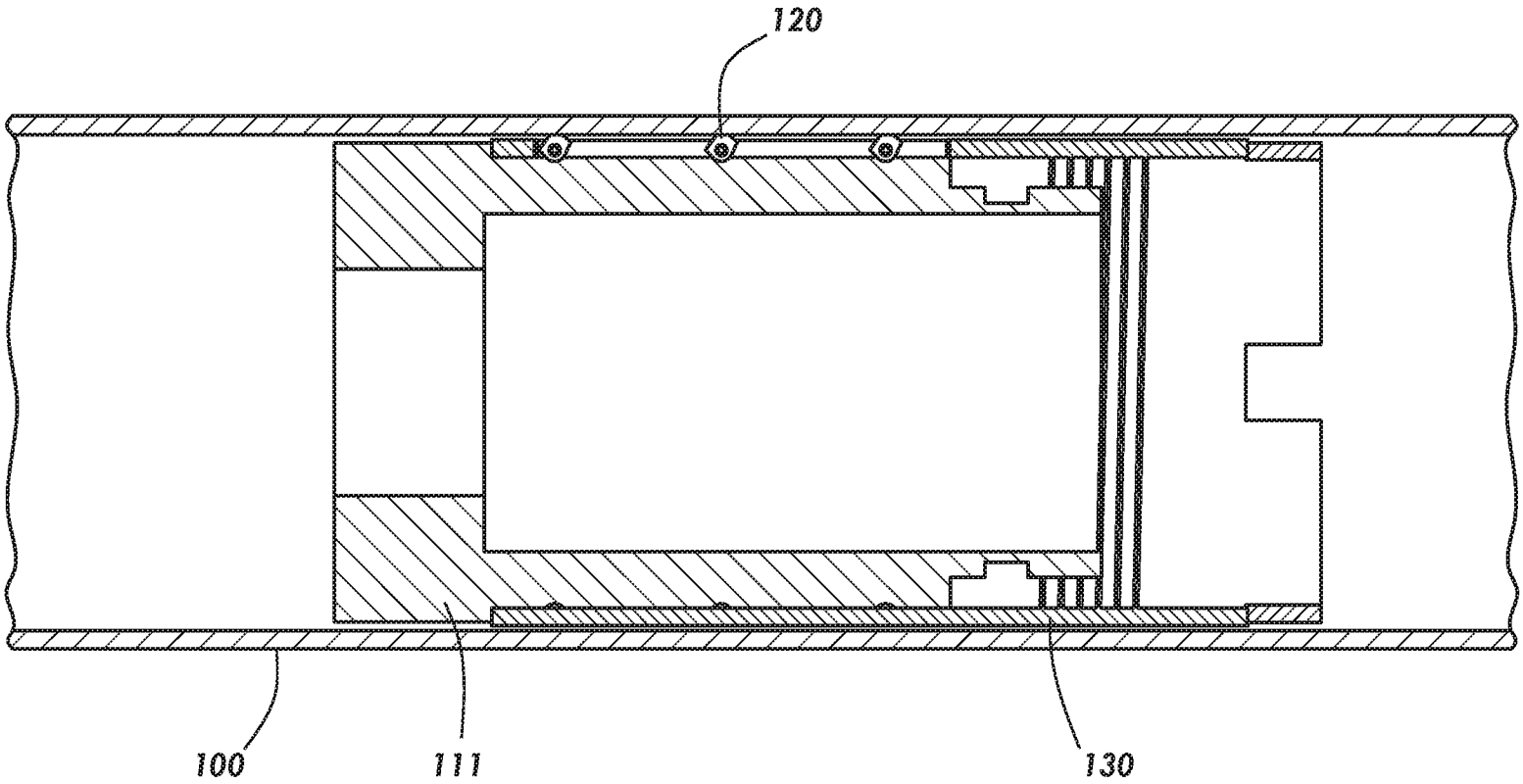
FIG. 7 is cross-sectional view of the assembly after anchoring the housing to the inside of the tubing string.

The rotating sleeve 140 is caused to continue to rotate clockwise or counter-clockwise until the first frangible device 141 shears. The rotating sleeve 140 is then released from engagement with the body 111, housing 130, and installation sleeve 150. After the rotating sleeve 140 is released, the installation sleeve 150 can be released by unthreading the fastener 151 from the tubing string 100 and installation sleeve 150. As shown in FIG. 7, when both of the rotating sleeve 140 and installation sleeve 150 are released, the rotating sleeve and installation sleeve can be removed from the assembly.

As discussed above, the downhole tool component can be included in the anchoring assembly prior to anchoring the housing to the ID of the tubing string. Alternatively, the downhole tool component can be installed after the housing 130 has been anchored to the ID 101 of the tubing string 100. After the housing has been anchored and the installation sleeve and rotating sleeve have been removed from the assembly above ground, the methods can further include the step of introducing the tubing string into a wellbore. The tubing string 100 can be run into the wellbore using any technique and equipment known to those skilled in the art.

It should be noted that the anchoring assembly illustrated in the drawings and as described herein is merely one example of a wide variety of embodiments and applications in which the principles of this disclosure can be utilized. It should be clearly understood that the principles of this disclosure are not limited to any of the details of the anchoring assembly, or components thereof, depicted in the drawings or described herein. Furthermore, a well system and the anchoring assembly can include other components not depicted in the drawing.

An embodiment of the present disclosure is a system for anchoring a housing to an inner diameter of a tubing string, the system comprising: a wellbore tool component; and an anchoring assembly positioned at an end of the tubing string, the anchoring assembly comprising; a body; the housing, wherein the housing is positioned around an outer circumference of at least a portion of the body; an installation sleeve; a rotating sleeve in threaded connection with the housing and the installation sleeve; and a plurality of anchoring buttons located within a plurality of cutouts on the housing, wherein the plurality of anchoring buttons circumvolve around a pin, and wherein an edge on the plurality of anchoring buttons lockingly engages with the inner diameter of the tubing string. Optionally, the system further comprises wherein the body is releasably attached to the rotating sleeve by a first frangible device. Optionally, the system further comprises wherein the first frangible device is selected from a shear pin, a shear screw, a shear ring, a load ring, a lock ring, a pin, or a lug. Optionally, the system further comprises wherein the installation sleeve is removably attached to the end of the tubing string via a fastener. Optionally, the system further comprises wherein a second frangible device is located below the installation sleeve and penetrates into the rotating sleeve. Optionally, the system further comprises wherein the plurality of anchoring buttons comprise a rounded portion, a hole for receiving the pin, and two faces that define the edge. Optionally, the system further comprises wherein the edge has an angle in the range of 80° to 110°. Optionally, the system further comprises wherein each of the plurality of anchoring buttons are secured to the housing within the plurality of cutouts by the pin. Optionally, the system further comprises wherein the housing comprises a first and second pin end receiver, wherein a first end of the pin is contained within the first pin end receiver, and wherein a second end of the pin is contained within the second pin end receiver. Optionally, the system further comprises wherein the body comprises one or more grooves, wherein the rounded portion of the anchoring buttons is positioned within the grooves, and wherein the rounded portion allows the anchoring buttons to circumvolve around the pin within the grooves. Optionally, the system further comprises wherein the anchoring buttons are made from a material selected from ceramics, hardened steel, titanium, tungsten, diamond, and carbides of any of the foregoing metals.

Another embodiment of the present disclosure is a method of anchoring a housing to an inner diameter of a tubing string comprising: installing an anchoring assembly at an end of the tubing string, wherein the anchoring assembly comprises: a body; the housing, wherein the housing is positioned around an outer circumference of at least a portion of the body; an installation sleeve; a rotating sleeve in threaded connection with the housing and the installation sleeve; and a plurality of anchoring buttons located within a plurality of cutouts on the housing; causing movement of the body along a longitudinal axis of the tubing string towards the end of the tubing string, wherein the movement causes the plurality of anchoring buttons to circumvolve around a pin, and wherein an edge on the plurality of anchoring buttons lockingly engages with the inner diameter of the tubing string after circumvolving; releasing both of the installation sleeve and the rotating sleeve from engagement with the tubing string, the body, and the housing; and removing the installation sleeve and the rotating sleeve from the anchoring assembly. Optionally, the method further comprises wherein the body is releasably attached to the rotating sleeve by a first frangible device. Optionally, the method further comprises wherein the first frangible device is selected from a shear pin, a shear screw, a shear ring, a load ring, a lock ring, a pin, or a lug. Optionally, the method further comprises wherein the installation sleeve is removably attached to the end of the tubing string via a fastener. Optionally, the method further comprises wherein a second frangible device is located below the installation sleeve and penetrates into the rotating sleeve. Optionally, the method further comprises wherein the plurality of anchoring buttons comprise a rounded portion, a hole for receiving the pin, and two faces that define the edge. Optionally, the method further comprises wherein the edge has an angle in the range of 80° to 110°. Optionally, the method further comprises wherein each of the plurality of anchoring buttons are secured to the housing within the plurality of cutouts by the pin. Optionally, the method further comprises wherein the housing comprises a first and second pin end receiver, wherein a first end of the pin is contained within the first pin end receiver, and wherein a second end of the pin is contained within the second pin end receiver. Optionally, the method further comprises wherein the body comprises one or more grooves, wherein the rounded portion of the anchoring buttons is positioned within the grooves, and wherein the rounded portion allows the anchoring buttons to circumvolve around the pin within the grooves. Optionally, the method further comprises wherein the anchoring buttons are made from a material selected from ceramics, hardened steel, titanium, tungsten, diamond, and carbides of any of the foregoing metals. Optionally, the method further comprises wherein the movement of the body is caused by rotating the rotating sleeve clockwise or counter-clockwise relative to a longitudinal axis of the tubing string. Optionally, the method further comprises wherein the installation sleeve and the housing are inter-connected by castellated protrusions on the installation sleeve and castellated indentations on the housing, and wherein the castellated inter-connection prevents the housing from rotating during rotation of the rotating sleeve. Optionally, the method further comprises wherein the body is releasably attached to the rotating sleeve by a first frangible device, and wherein rotation of the rotating sleeve causes the first frangible device to shear when a force above the shear rating of the first frangible device is reached. Optionally, the method further comprises releasing the installation sleeve from the anchoring assembly after the first frangible device shears. Optionally, the method further comprises introducing the tubing string into a wellbore after removing the installation sleeve and the rotating sleeve from the anchoring assembly.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more anchoring frangible devices, pin ends, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A system for anchoring a housing to an inner diameter of a tubing string, the system comprising:
- a wellbore tool component; and
- an anchoring assembly positioned at an end of the tubing string, the anchoring assembly comprising;
  - a body;
  - the housing, wherein the housing is positioned around an outer circumference of at least a portion of the body;
  - an installation sleeve;
  - a rotating sleeve in threaded connection with the housing and the installation sleeve, wherein the installation sleeve is removably attached to the end of the tubing string via a fastener; and
  - a plurality of anchoring buttons located within a plurality of cutouts on the housing, wherein each of the plurality of anchoring buttons circumvolve around one of a plurality of pins, and wherein an edge on each of the plurality of anchoring buttons lockingly engages with the inner diameter of the tubing string.

2. The system according to claim 1, wherein the body is releasably attached to the rotating sleeve by a first frangible device.

3. The system according to claim 2, wherein the first frangible device is selected from a shear pin, a shear screw, a shear ring, a load ring, a lock ring, a pin, or a lug.

4. The system according to claim 1, wherein a second frangible device is located below the installation sleeve and penetrates into the rotating sleeve.

5. The system according to claim 1, wherein each of the plurality of anchoring buttons comprise a rounded portion, a hole for receiving the pin, and two faces that define the edge.

6. The system according to claim 5, wherein the body comprises one or more grooves, wherein the rounded portion of the anchoring buttons is positioned within the grooves, and wherein the rounded portion allows the anchoring buttons to circumvolve around the pin within the grooves.

7. The system according to claim 1, wherein the edge has an angle in the range of 80° to 110°.

8. The system according to claim 1, wherein each of the plurality of anchoring buttons are secured to the housing within the plurality of cutouts by the pin.

9. The system according to claim 8, wherein the housing comprises a first pin end receiver and a second pin end receiver, wherein a first end of the pin is contained within the first pin end receiver, and wherein a second end of the pin is contained within the second pin end receiver.

10. The system according to claim 1, wherein the anchoring buttons are made from a material selected from ceramics, hardened steel, titanium, tungsten, diamond, and carbides of any of the foregoing metals.

11. A method of anchoring a housing to an inner diameter of a tubing string comprising:
- installing an anchoring assembly at an end of the tubing string, wherein the anchoring assembly comprises:
  - a body;
  - the housing, wherein the housing is positioned around an outer circumference of at least a portion of the body;
  - an installation sleeve;
  - a rotating sleeve in threaded connection with the housing and the installation sleeve; and
  - a plurality of anchoring buttons located within a plurality of cutouts on the housing;

causing movement of the body along a longitudinal axis of the tubing string towards the end of the tubing string, wherein the movement causes each of the plurality of anchoring buttons to circumvolve around one of a plurality of pins, and wherein an edge on each of the plurality of anchoring buttons lockingly engages with the inner diameter of the tubing string after circumvolving;

releasing both of the installation sleeve and the rotating sleeve from engagement with the tubing string, the body, and the housing; and removing the installation sleeve and the rotating sleeve from the anchoring assembly.

12. The method according to claim 11, wherein each of the plurality of anchoring buttons comprise a rounded portion, a hole for receiving the pin, and two faces that define the edge.

13. The method according to claim 12, wherein the body comprises one or more grooves, wherein the rounded portion of the anchoring buttons is positioned within the grooves, and wherein the rounded portion allows the anchoring buttons to circumvolve around the pin within the grooves.

14. The method according to claim 11, wherein the movement of the body is caused by rotating the rotating sleeve clockwise or counter-clockwise relative to a longitudinal axis of the tubing string.

15. The method according to claim 14, wherein the installation sleeve and the housing are inter-connected by castellated protrusions on the installation sleeve and castellated indentations on the housing, and wherein the castellated inter-connection prevents the housing from rotating during rotation of the rotating sleeve.

16. The method according to claim 14, wherein the body is releasably attached to the rotating sleeve by a first frangible device, and wherein rotation of the rotating sleeve causes the first frangible device to shear when a force above the shear rating of the first frangible device is reached.

17. The method according to claim 16, further comprising releasing the installation sleeve from the anchoring assembly after the first frangible device shears.

18. The method according to claim 11, further comprising introducing the tubing string into a wellbore after removing the installation sleeve and the rotating sleeve from the anchoring assembly.

19. An anchoring assembly comprising:

a body;

a housing, wherein the housing is positioned around an outer circumference of at least a portion of the body;

an installation sleeve, wherein the installation sleeve is removably attached to an end of a tubing string via a fastener;

a rotating sleeve in threaded connection with the housing and the installation sleeve; and a plurality of anchoring buttons located within a plurality of cutouts on the housing, wherein each of the plurality of anchoring buttons circumvolve around one of a plurality of pins, and wherein an edge on each of the plurality of anchoring buttons lockingly engages with an inner diameter of a tubing string.

* * * * *